US008297866B2

(12) United States Patent
de Gery

(10) Patent No.: US 8,297,866 B2
(45) Date of Patent: Oct. 30, 2012

(54) ACTUATOR POUCH AND METHOD THEREOF

(76) Inventor: Didier de Gery, Los Gatos, CA (US)

( * ) Notice: Subject to any disclaimer, the term of this patent is extended or adjusted under 35 U.S.C. 154(b) by 0 days.

(21) Appl. No.: 13/028,802

(22) Filed: Feb. 16, 2011

(65) Prior Publication Data

US 2011/0200379 A1 Aug. 18, 2011

Related U.S. Application Data

(60) Provisional application No. 61/304,840, filed on Feb. 16, 2010.

(51) Int. Cl.
*B43K 5/14* (2006.01)

(52) U.S. Cl. ..... 401/132; 401/133

(58) Field of Classification Search ..... 401/132, 401/133; 383/203–206, 210, 211, 66
See application file for complete search history.

(56) References Cited

U.S. PATENT DOCUMENTS 2,371,521 A * 3/1945 Heywood et al. ..... 383/211
3,306,292 A * 2/1967 Spees ..... 604/306
3,369,267 A * 2/1968 Friedland et al. ..... 15/104.94
3,453,661 A * 7/1969 Repko ..... 401/132
3,806,260 A * 4/1974 Miller ..... 401/7
3,826,259 A * 7/1974 Bailey ..... 604/310
5,046,608 A * 9/1991 Laipply ..... 206/209
6,007,264 A * 12/1999 Koptis ..... 401/132
6,547,468 B2 * 4/2003 Gruenbacher et al. ..... 401/133
7,108,440 B1 * 9/2006 Gruenbacher et al. ..... 401/132
7,575,384 B2 * 8/2009 Bauer et al. ..... 401/7
7,651,290 B2 * 1/2010 Bauer et al. ..... 401/133
7,828,176 B2 * 11/2010 Harper ..... 222/207
7,950,864 B2 * 5/2011 Bauer et al. ..... 401/132
2002/0126921 A1 * 9/2002 Bell ..... 383/210
2002/0197094 A1 * 12/2002 Gruenbacher et al. ..... 401/133
2003/0086743 A1 * 5/2003 Gruenbacher et al. ..... 401/133
2009/0241277 A1 * 10/2009 Lam et al. ..... 15/104.94

* cited by examiner

*Primary Examiner* — David Walczak
*Assistant Examiner* — Bradley Oliver
(74) *Attorney, Agent, or Firm* — Schmeiser, Olsen & Watts, LLP

(57) ABSTRACT

A pouch comprising a top pouch layer, a bottom pouch layer sealed to the top pouch layer to form a reservoir, wherein the reservoir is configured to hold contents, and an actuator formed from a portion of the top pouch layer, wherein the portion of the top layer is sealed with a corresponding portion of the bottom layer, wherein the actuation of the actuator releases the contents from the reservoir is provided. Furthermore, an associated method is also provided.

11 Claims, 13 Drawing Sheets

ACTUATOR POUCH AND METHOD THEREOF

CROSS-REFERENCE TO RELATED APPLICATIONS

This non-provisional application claims priority to a U.S. Provisional Application Ser. No. 61/304,840 filed Feb. 16, 2010 with the United States Patent and Trademark Office.

FIELD OF TECHNOLOGY

The following relates to an apparatus and method of sealing contents inside a pouch with a quick and convenient pull tab opening system.

BACKGROUND

Convenience and portability have become sought after attributes in today's marketplace. Often times, durability and shelf-life are sacrificed to achieve convenience and portability. In the field of pouches, in particular pouches containing fluids, the durability of the pouch and the shelf-life of the contents must not be significantly sacrificed. For instance, a durable pouch may be too bulky to be portable. Furthermore, a pouch having increased shelf-life may be rigorously sealed which is cumbersome and frustrating when struggling to tear open the pouch to access its contents. To increase durability, a product may be packaged in a bulky bottle or container, which is inconvenient, impractical, and awkward to carry around. To increase shelf-life, a product may be sealed very tightly and tediously, making it extremely difficult to open the package, as well as increasing the cost to package the contents.

Thus, there is a need for a device and method which overcomes the aforementioned deficiencies in the art for sealing contents inside a pouch with a quick and convenient pull tab opening system.

SUMMARY

A first aspect of the present invention provides a pouch comprising a top pouch layer, a bottom pouch layer sealed to the top pouch layer forming a reservoir, wherein the reservoir holds contents, and an actuator formed from a portion of the top pouch layer, wherein the portion of the top layer is sealed with a corresponding portion of the bottom layer, wherein the actuation of the actuator releases the contents from the reservoir.

A second aspect of the present invention provides a pouch comprising a top pouch layer heat sealed to a bottom pouch layer to form at least one reservoir, wherein the at least one reservoir holds contents, an intermediate layer, wherein an edge of the intermediate layer is sealed to the top pouch layer, and an actuator formed from a portion of the intermediate layer, wherein the actuator breaches a portion of the seal between the top pouch layer and the intermediate layer.

A third aspect of the present invention provides a method of packaging a fluid comprising, joining a bottom pouch layer with a top pouch layer to form at least one reservoir, wherein each of the at least one reservoirs holds contents, extruding a portion of the top pouch layer to form an actuator, wherein the actuator is formed from an area that does not hold contents, and actuating the actuator to reveal at least one opening, the at least one opening configured to allow contents to pass through.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments of this invention will be described in detail, with reference to the following figures, wherein like designations denote like members wherein.

DETAILED DESCRIPTION OF THE DRAWINGS

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1A:
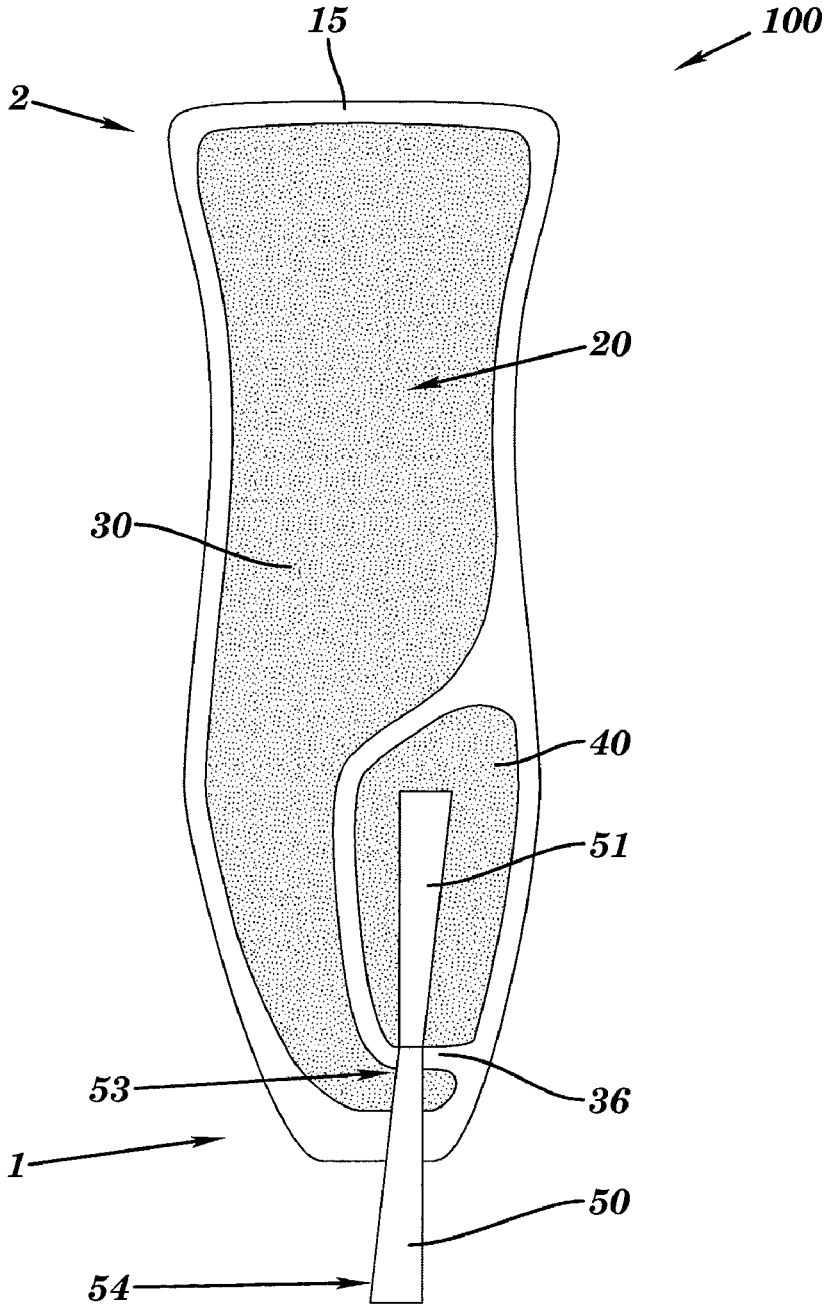
FIG. 1A depicts a top view of an embodiment of a pouch.
Figure 1B:
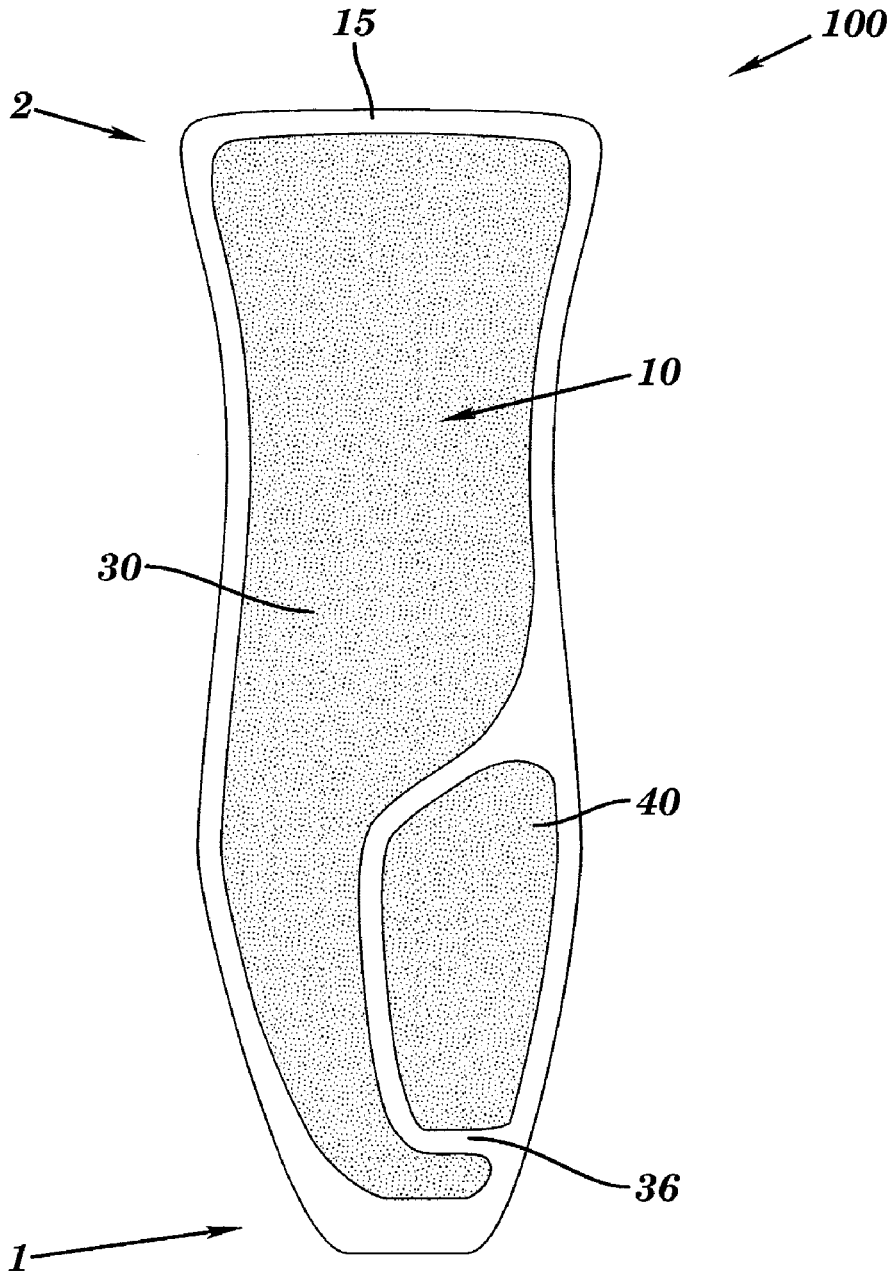
FIG. 1B depicts a bottom view of an embodiment of a pouch.

Referring now to the drawings, FIGS. 1A and 1B depict an embodiment of a pouch 100. Pouch 100 may include a top pouch layer 20, a bottom pouch layer 10 sealed to the top pouch layer 20 forming a reservoir 30, wherein the reservoir 30 may hold contents 35, a actuator 50 formed from a portion, or area, of the top pouch layer 20, wherein the portion, or area, of the top pouch layer 20 may be sealed with a portion of the bottom pouch layer 10 to restrict access of contents 35, and wherein pulling the actuator 50 forms an access opening 60 in the reservoir 30, allowing the contents 35 to exit the reservoir 30. In an alternative embodiment, pouch 100 may also include a top pouch layer 20 heat sealed to a bottom pouch layer 10 to form at least one reservoir 30, wherein the at least one reservoir 30 may hold contents 35, a actuator 50 proximate a first end 1, wherein the actuator 50 may breach a portion of the heat seal 36 proximate the first end 1, and an access opening 60 created by the breach of the heat seal 36 allowing the contents 35 to exit the reservoir 30. Additionally, pouch 100 may include a pull tab zone 40, a pull tab cut-out 51, a second end 2, and a seal 36.

Pouch 100 may include a bottom pouch layer 10 and a top pouch layer 20, which may be heat sealed at the edges to form a reservoir 30 between the pouch layers 20, 10, which may hold contents 35. For example, the perimeters of the top and bottom pouch layers 20, may be heat sealed to each other to form a reservoir 30 between the pouch layers 20, 10. A reservoir 30 may also be a pouch, pocket, fluid zone, a first reservoir, container, sack, enclosure, compartment, cavity, chamber, void, and the like. Moreover, the reservoir 30 may be formed by heat sealing the pouch layers 20, 10 in any shape, pattern, design, profile, etc., and at any location, portion, or area between the top and bottom pouch layers 20, 10. For example, a reservoir 30 may be formed without heat sealing along the edges, but heat sealing, or otherwise sealing, the top and bottom pouch layers 20, 10 at any point or location within the edges of the pouch layers 20, 10. Thus, the heat sealing of the edges and/or other areas of the top and bottom pouch layers 10, 20 may create a seal 36, as shown in FIGS. 1A and 1B. The seal 36 can be a cohesive bond with peel-seal characteristics. The seal 36, specifically a heat seal bond, can be weaker than the parent material so that the actuator 50 may rip across the seal 36 as well as a feed channel. Embodiments of pouch 100 may use Low Density Polyethylene (LDPE) as a cohesive sealing material for seal 36. Further embodiments of pouch 100, or seal 36, may be doped with Butalene to form discontinuities and reduce the peel strength. The seal 36 characteristics and properties (e.g. strength) can be selected to balance the function of the actuator 50 and the seal integrity of the pouch 100. For example, the actuator 50 may function properly if pulling the actuator 50 in a coplanar direction (i.e. same or similar plane of the pouch 100 or top/bottom layers 20, 10) away from the center of the pouch 100 results in a breach of the seal 36 and creates an access opening 60 in the reservoir 30. In the absence of a standard test/industry requirement for the strength of the seals, one having skill in the art should appreciate that a range of pressure and/or strength requirements may be applied to the pouch 100 in a static mode. In many embodiments, a 5 psi force can be applied to the package in a static mode. If the integrity of the seal 36 is maintained for a certain duration (e.g. overnight), the pouch 100 will be suitable for use.

Moreover, the location or path of the seal 36 of pouch 100 may define the shape, volume, profile, design, pattern, etc., of the reservoir 30, as well as a pull tab zone 40. Those skilled in the art should appreciate that the shape, volume, profile, design, pattern, etc., of the reservoir 30 may vary, and in many embodiments, may vary depending on the location and/or pattern of the seal 36. For instance, if a smaller, lower volume reservoir 30 is desired, the seal 36 may be adjusted accordingly, and vice versa. In one non-limiting example, the pouch 100 having a reservoir 30 may be used as a single dose/unit package, wherein the necessary amount, volume, or dosage of contents 35 may be predetermined during the manufacturing stage and stored in the reservoir 30 to administer a single dosage; the size of the pouch 100 and the area created by the seal 36 may be adjusted accordingly.

Furthermore, the bottom pouch layer 10 and top pouch layer 20 may be designed and/or manufactured in various sizes. In most embodiments, the shape, or profile, of the top and bottom pouch layers 20, 10 may correspond with each other. In other words, the top and bottom pouch layers 20, 10 may be dimensioned exactly the same as each other to facilitate the forming an evenly shaped reservoir 30, to provide an ergonomic grip or shape of the pouch 100, or to maximize aesthetic appeal of the pouch 100. Those skilled in the art should appreciate that the dimensions, and/or shape of the top and bottom pouch layers 10, 20 may vary, and need not be exactly the same. For example, the bottom pouch layer 10 may be wider, longer, or have more surface area than the top pouch layer 20, or vice versa. The design, shape, and/or profile of the top and bottom pouch layers 20, 10 should not be limited in any way to the design, shape, and/or profile depicted in FIGS. 1A-9, as those embodiments are used simply for exemplary purposes. Moreover, the pouch layers 20, 10 may be made of a laminate of LDPE/Aluminum foil/PET. Typical materials for the pouch layers 20, 10 are laminates having a sealing material, such as LDPE (typically 1 to 1.5 mils), a vapor barrier layer such as aluminum foil (1 mil or less), and a structural layer such as PET and sometimes printing ink or a label overlam made of paper or plastic with graphics. However, the exact composition and relative thickness of each layer depends on the material being inserted (i.e. contents 35) and the shelf-life demanded. In some embodiments, metalized mylar (e.g. Polyethylene Terephthalate (PET) with a few atoms of aluminum: Mylar balloon) may be used instead of the aluminum foil. Furthermore, it is possible to use laminates which include other barrier materials such as polypropylene, Nylon, Barrex and ethylene acrylic acid. For instance, ethylene acrylic acid may be used singly and still provide good barrier qualities. In many embodiments, a laminate of PET/LDPE will suffice.

In addition to the top and bottom pouch layers 20, 10 being sealed together to form a reservoir 30, the edges of a separate portion, or area, of the top pouch layer 20 may be sealed to the edges of a separate portion, or area, of the bottom pouch layer 10 to form a pull tab zone 40. For example, a portion, or area, of the top pouch layer 20 not forming a part of the reservoir 30 and a portion, or area, of the bottom pouch layer 10 not forming a part of the reservoir 30 may form a pull tab zone 40. Alternatively, after the reservoir 30 is formed (and typically prior to contents 35 being inserted into reservoir 30), the pull tab zone 40 may be formed by portions of the top and bottom pouch layers 20, 10 that form the reservoir 30. For instance, after the reservoir 30 is formed, a pull tab zone 40 perimeter may be formed within the perimeter that forms the reservoir 30. Furthermore, the pull tab zone 40 may restrict access to contents 35 located in the reservoir 30. In other words, the pull tab zone 40 keeps the contents 35 from entering, such that no contents 35 may be present in the pull tab zone 40. Although the pull tab zone 40 usually does not contain any contents 35, those skilled in the art should appreciate that one embodiment of the pull tab zone 40 may include contents 35. The pull tab zone 40 may be created by sealing a portion of the top layer 20 to the bottom layer 10, as shown in FIGS. 1A and 1B. The sealed perimeter forming the pull tab zone 40 may be a part of the overall seal 36. In most embodiments, the pull tab zone 40 and the reservoir 30 share a boundary, such as seal 36. Sharing a boundary, edge, or seal 36 may allow a actuator 50, located within the pull tab zone 40, to breach the shared seal 36 and allow the flow of the contents 35 out of the reservoir 30. The pull tab zone 40 may also be a reservoir, pouch, pocket, container, sack, enclosure, compartment, cavity, chamber, void, and the like. Additionally, the pull tab zone 40 may be flat, comprising a portion of the top pouch layer 20 and a portion of the bottom pouch layer 10 that may be pressed or sealed together. In one embodiment, the reservoir 30 may be a first reservoir and the pull tab zone 40 may be a second reservoir. Furthermore, the pull tab zone 40 may be located on the pouch 100 proximate the reservoir 30 in various configurations and locations. In another embodiment, the pull tab zone 40 may be in a side by side configuration with the reservoir 30. In another embodiment, the pull tab zone 40 may be located above, slightly above, directly above, below, slightly below, directly below, to the side, slightly to the side, or any combination thereof with respect to the reservoir 30. In yet another embodiment, the reservoir 30 may encompass the pull tab zone 40, such that the pull tab zone 40 is created by heat sealing a perimeter from within the perimeter that defines the reservoir 30.

With continued reference to FIGS. 1A and 1B, a actuator 50 may be formed from the pull tab zone 40. Actuator 50 includes a first end 53, and a second end 54. Actuator 50 may also be a strip, pull tab, tearing portion, tab, release mechanism, and the like. In one embodiment, the actuator 50 may be formed using a portion of the top pouch layer 20. The portion of the top pouch layer 20 that may be used to form the actuator 50 may be a portion of the pull tab zone 40. In one embodiment, the actuator 50 may be formed by extruding, cutting out, and/or removing a portion of the top pouch layer 20, and then folding the extruded portion (actuator 50) back over the seal 36 towards the first end 1 of the pouch 100, such that the actuator 50 is coplanar with the pull tab zone 40, yet in a generally opposing direction. The actuator 50 may be folded back over the seal 36 without actually breaching the seal 36. For instance, the actuator 50 may be folded back towards the first end 1 of the pouch 100 until the first end 53 of the actuator 50 rests a distance prior to, or before, the seal 36. In this position, the contents 35 may still be secured in the reservoir 30, and the pouch 100 may be transported, stored, grabbed, packaged, injected with contents 35, or prepared for distribution and/or application. The second end 54 of the actuator 50 may extend towards the first end 1 of the pouch 100. In most embodiments, the second end 54 of the actuator 50 may extend a distance passed the first end 1 of the pouch 100 to facilitate the gripping of the actuator 50, and to facilitate the creation an access opening 60. Also, when the actuator 50 is formed and positioned proximate the first end 1, the inside surface of the bottom pouch layer 10 may be exposed, and may be referred to as the cut-out zone 51 of the pull tab zone 40. The actuator 50 may be various sizes and shapes. In one embodiment, it may be an elongated rectangle. In another embodiment, the actuator 50 may be tapered. It should be understood that the actuator 50 may be any shape or size so long as it may be folded back over the seal 36.

Figure 2:
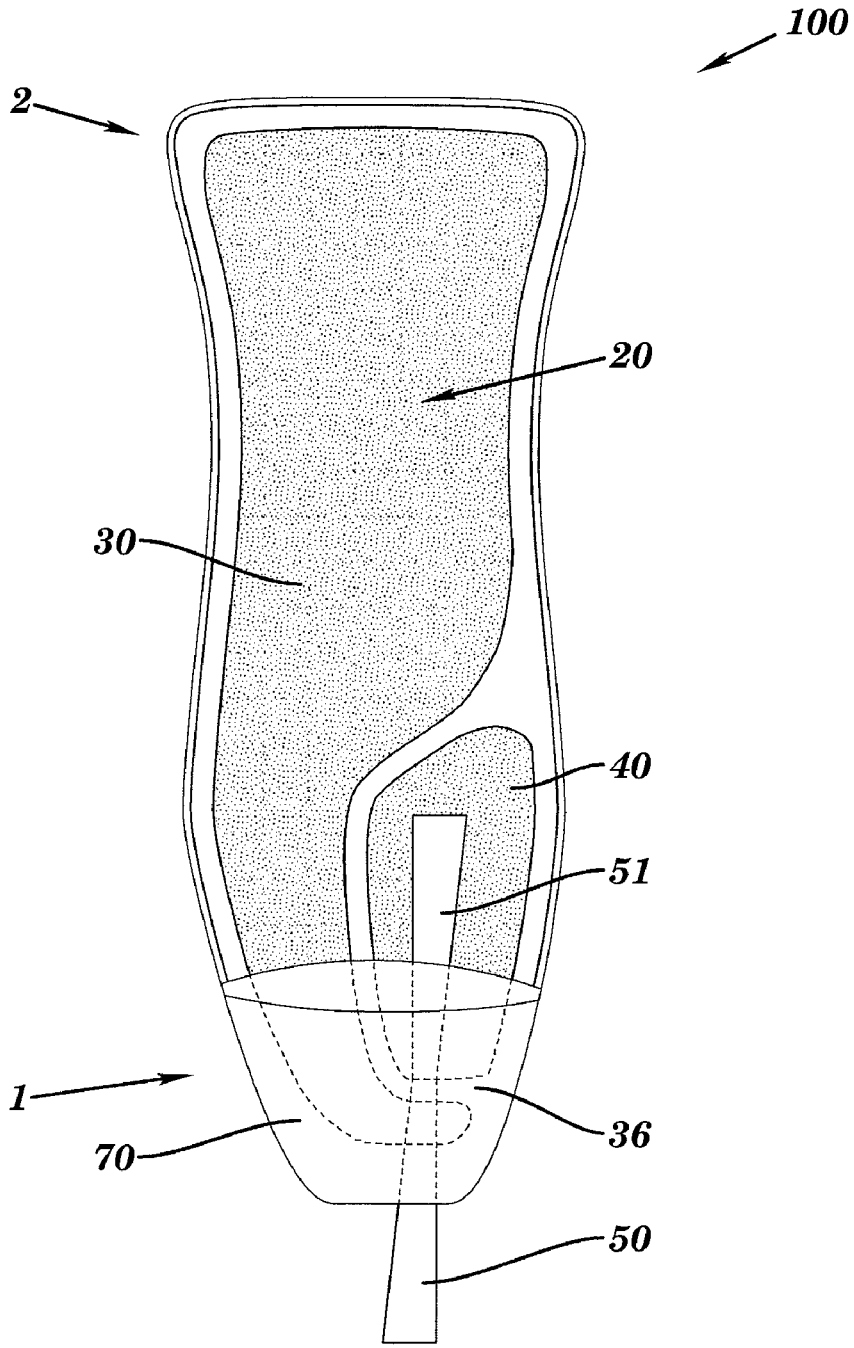
FIG. 2 depicts a top view of an embodiment of a pouch with an embodiment of an applicator.
Figure 3:
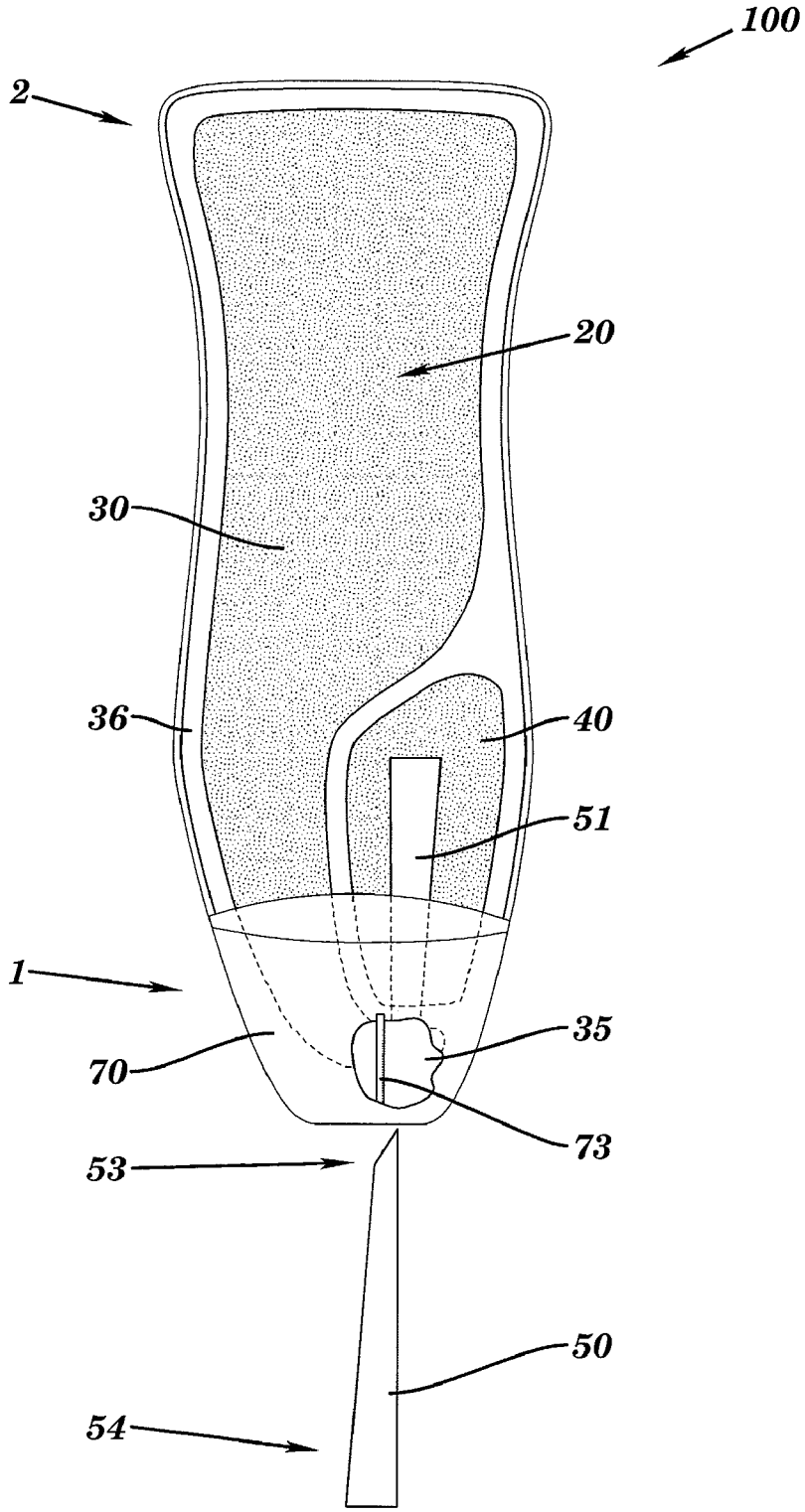
FIG. 3 depicts a top view of an embodiment of a pouch with an applicator, after pull tab has been pulled.

With continued reference to FIGS. 1A-1B, and additional reference to FIGS. 2 and 3, the actuator 50 may be actuated to release contents 35 from within the reservoir 30 of pouch 100. For instance, the actuaror 50 may be pulled to release the contents 35 which may be absorbed or partially absorbed by the applicator 70. The contents 35 may be released through an access opening 60 (shown clearly in FIG. 4B), which may be a breach or opening in the seal 36. To create an access opening 60 in the pouch 100, the actuator 50 may be grabbed, gripped, squeezed, etc., and pulled and/or folded back over the seal 36 and pulled towards the first end 1 (or further from the first end 1) of the pouch 100. The actuator 50 may be pulled and/or folded in the generally opposing direction from the pouch 100 to create, expose, or form an access opening 60. The second end 2 of the pouch may also be simultaneously gripped to provide a counterforce when pulling the actuator 50 from the pouch 100. When the actuator 50 is pulled, the first end 53 of the actuator 50 may shear against the seal 36, thereby breaching the seal 36. Once the seal 36 has been breached, removed, broken, etc., an access opening 60 may be formed, and contents 35 may exit, or exude, from the reservoir 30. Because the pull tab zone 40 and the reservoir 30 share a boundary, such as a portion of the seal 36, a breach of the shared portion of seal 36 may allow the contents 35 to exit the reservoir 30. Thus, one advantage of pouch 100 is that it can go from safely storing and/or preserving contents 35 to dispensing contents 35 for use with a single motion of pulling the actuator 50.

The access opening 60 may also be an opening, aperture, hole, access point, slit, slot, cut, gap, exit, puncture, vent, and the like. In many embodiments, the area of the access opening 60 corresponds with the width and/or area of the breached, or removed, portion of the seal 36. Ostensibly, the first end 53 of the actuator 50 may shear, cut, remove, break, breach, etc., a portion of the seal 36, wherein the size, shape, area, etc., of said portion of the seal 36 may be proportional to the size, shape, area, etc., of the first end 53. Therefore, the size, shape, area, etc., of the access opening 60 may be determined by the size, shape, area, etc., of the actuator 50, in particular, the size, shape, area, etc., of the first end 53 of the actuator 50. Furthermore, controlling the size, shape, area, etc., of the access opening 60 may also control, or help control, the flow rate of the contents 35. However, the flow rate may also depend on the viscosity of the contents 35, the stiffness of the top and bottom pouch layers 20, 10, and the geometry, or design of the reservoir 30, including the reservoir 30 area proximate the first end 1. The contents 35 may exit the reservoir 30 in a variety of methods. In one embodiment, the contents 35 may exude, ooze, excrete, discharge, seep, secrete, etc., out of the reservoir 30 after the access opening 60 is created. In another embodiment, the contents 35 may be forced, pushed, squeezed, etc., out of the reservoir 30 by applying a light force, usually with a finger, thumb, or hand, onto to the reservoir 30, or pouch 100. The natural act of holding the pouch 100 may apply enough force, and/or pressure to help the contents 35 flow out of the reservoir 30. In yet another embodiment, the contents 35 may exit the reservoir by a combination of the methods described herein.

The pouch 100, in particular, the reservoir 30 may house, enclose, contain, confine, store, preserve, encompass, hold, receive, accept, accommodate, etc., contents 35. The contents 35 may be any fluid or semi-solid that can flow, or be squeezed and/or forced out of a reservoir 30. A non-exhaustive list of potential contents 35 may include, skin cleaning products, such as alcohol, Betadine, iodine, and hydrogen peroxide, antibiotic creams, zinc creams, sun tan lotions, tanning lotions, topical medicines, such as acne medicine, Rosaria, and psoriasis, bug repellant, poison oak neutralizer, moisturizers, lotions, creams, toothpaste, tooth ache relief gel, denture gel and/or cream, shoe polish, specialty cleaners/polishers, such as silver, SS, copper, plastic, and dish washing fluid, paints, stains, adhesives, face paint colors, calking, spackle, condiments, such as catsup, mustard, relish, etc., and the like.

Moreover, the contents 35 may be placed within the reservoir 30 after the pouch 100 has been assembled. For instance, the contents 35 may be injected, added, inserted, placed, etc., within the reservoir 30 at the second end 2 of the pouch 100. The edges of the top pouch layer 20 may be sealed to the edges of the bottom pouch layer 10, with the exception of the bottom edge 15 proximate the second end 2, leaving an opening proximate the second end 2. Therefore, contents 35 may be added, injected, inserted, etc., in the opening at the second end 2. Once the contents 35 are inside the reservoir 30, the contents 35 may be sealed for storage and preservation by sealing the bottom edge 15.

With continued reference to FIG. 3, an applicator 70 may be placed proximate the first end 1. The applicator 70 may be placed over the top pouch layer 20 proximate the first end 1 only, it may be placed over the bottom pouch layer 10 proximate the first end 1 only, or the applicator may be placed on both the top and bottom pouch layers 20, 10 proximate the first end 1. Additionally, the applicator 70 may completely encompass, cover, or surround the first end 1 of the pouch 100. The placement of the applicator 70 may not affect the opening system described herein because the actuator 50 shears the seal 36 beneath the applicator 70; thus, an access opening may be formed or created underneath the applicator 70. Accordingly, an applicator 70 may be placed substantially over an access opening 60 which may be created when the actuator 50 has been pulled. Moreover, the applicator 70 may be fastened to the pouch 100 by various methods, such as pattern glue; however, the bonding or fastening of the applicator 70 to the pouch 100 must not interfere with the movement of the actuator 50, which may be located underneath the applicator 70 proximate the first end 1. The contents 35 may exit, exude, or flow out of the reservoir 30 through the access opening 60 to reach the applicator 70. The applicator 70 may be either porous or non-porous, usually determined by the contents 35 being dispensed. In addition, the applicator 70 may be open cell foam, felt material, woven cloth, or non-woven cloth. Additional applicator 70 materials include reticulated foams, knit fabric (a hook and loop fastener), felts (synthetic and natural), and flocked material. If the applicator 70 is porous, the contents 35 may flow through the applicator 70. If the applicator 70 is non-porous, then the applicator 70 may either have an aperture 73 to allow the contents 35 to flow to the surface, or may have a guide or channel to direct the contents 35 to the surface of the applicator 70. Furthermore, shape and/or stiffness of the applicator 70 may accommodate the type of contents 35 in the reservoir 30. For example, if the pouch 100 contains caulk for filling holes or gaps in tile, the applicator may be manufactured and/or designed to have a higher stiffness, or include a 90° edge. In some embodiments, such as caulking, no applicator 70 is needed. For instance, the tip of the pouch 100 proximate the first end 1 may be shaped to suitably dispense and apply the contents 35.

Figure 4A:
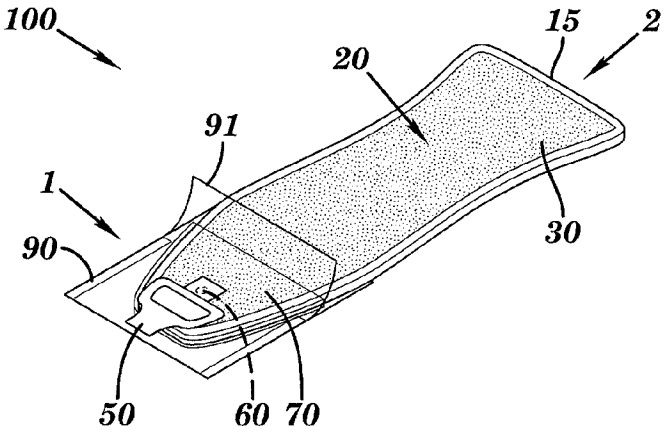
FIG. 4A depicts a perspective view of an embodiment of a pouch having an outer pouch.
Figure 4B:
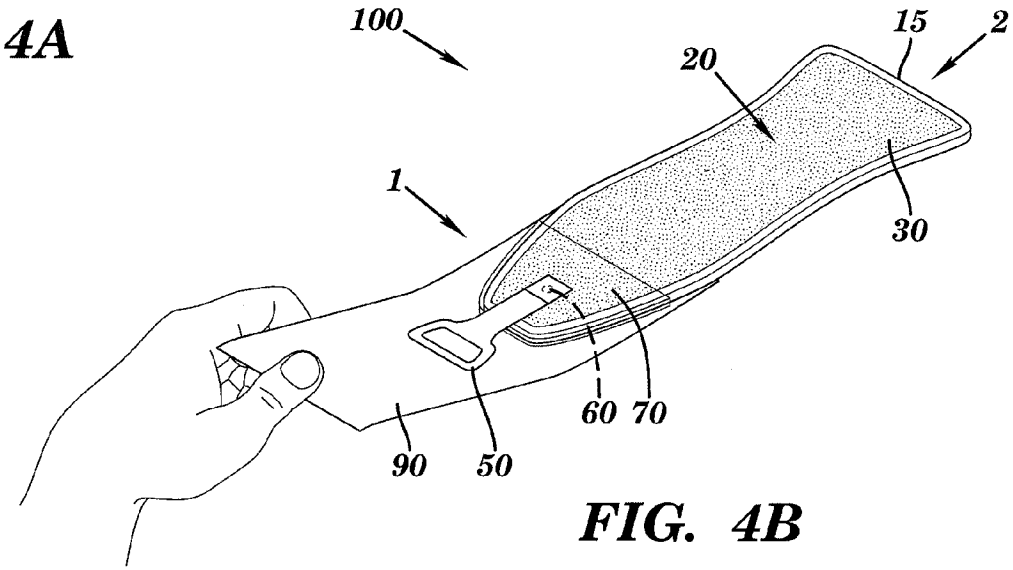
FIG. 4B depicts a perspective view of an embodiment of a pouch having an outer pouch being removed from the pouch before breaching a seal.
Figure 4C:
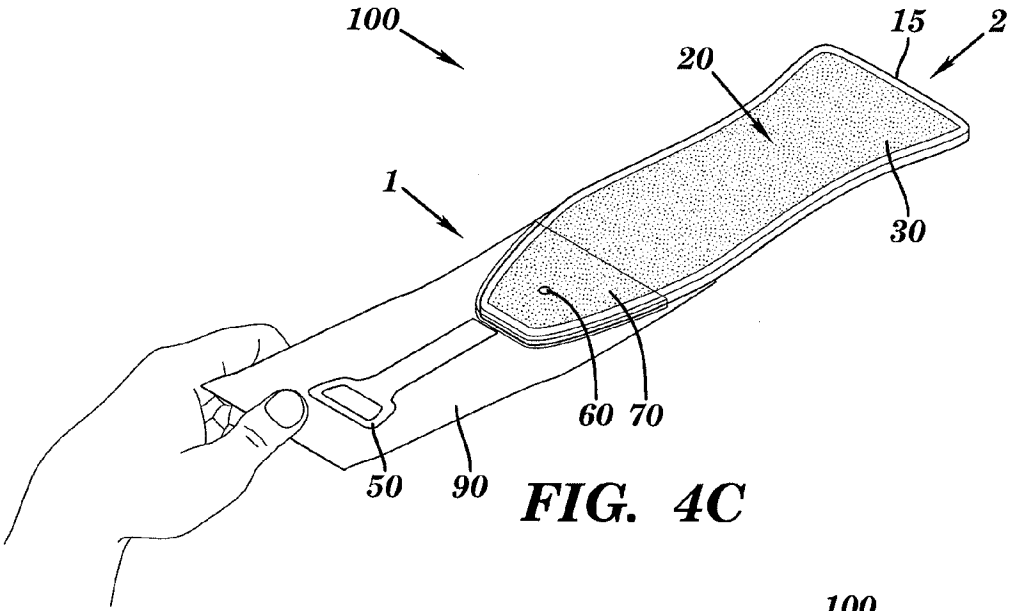
FIG. 4C depicts a perspective view of an embodiment of a pouch having an outer pouch being removed from pouch after opening is created.
Figure 4D:
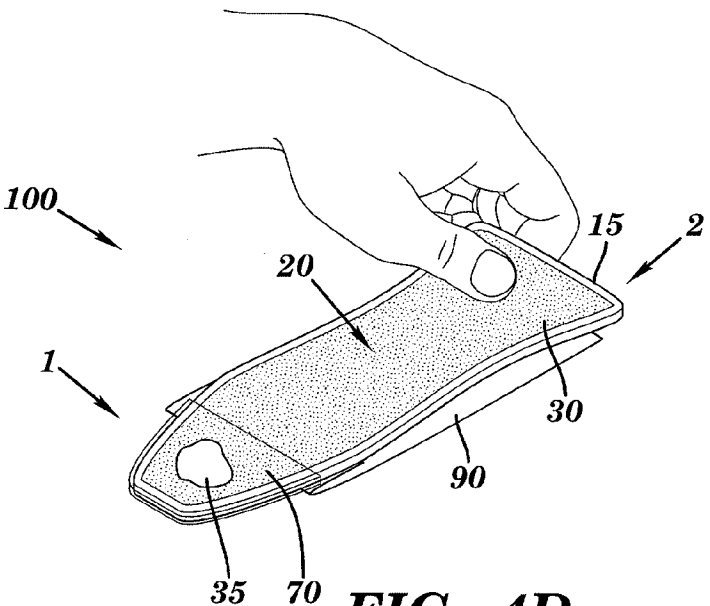
FIG. 4D depicts a perspective view of an embodiment of a pouch with an applicator and contents released from reservoir.
Figure 4F:
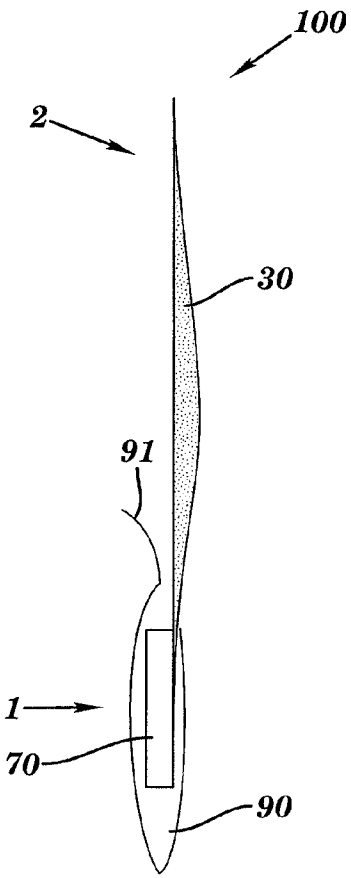
FIG. 4F depicts a side view of an embodiment of a pouch having an outer pouch.
Figure 4E:
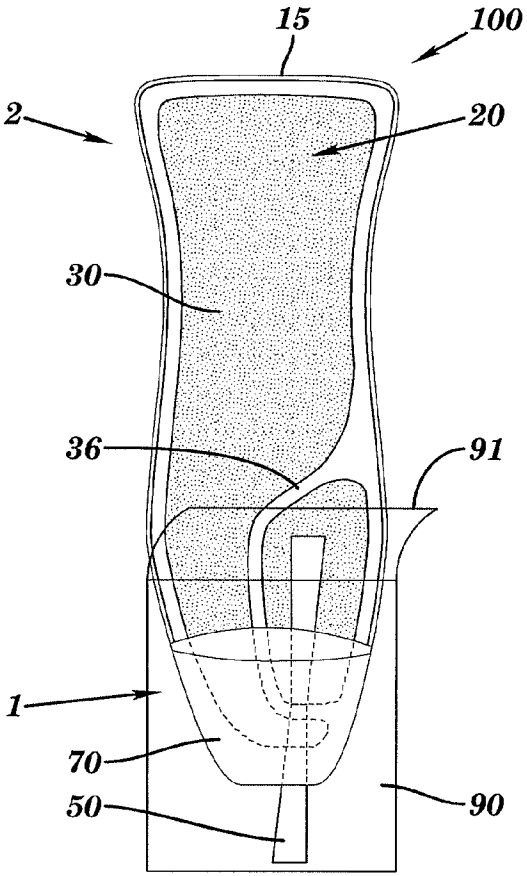
FIG. 4E depicts a perspective view of an embodiment of a pouch having an outer pouch.
Figure 4G:
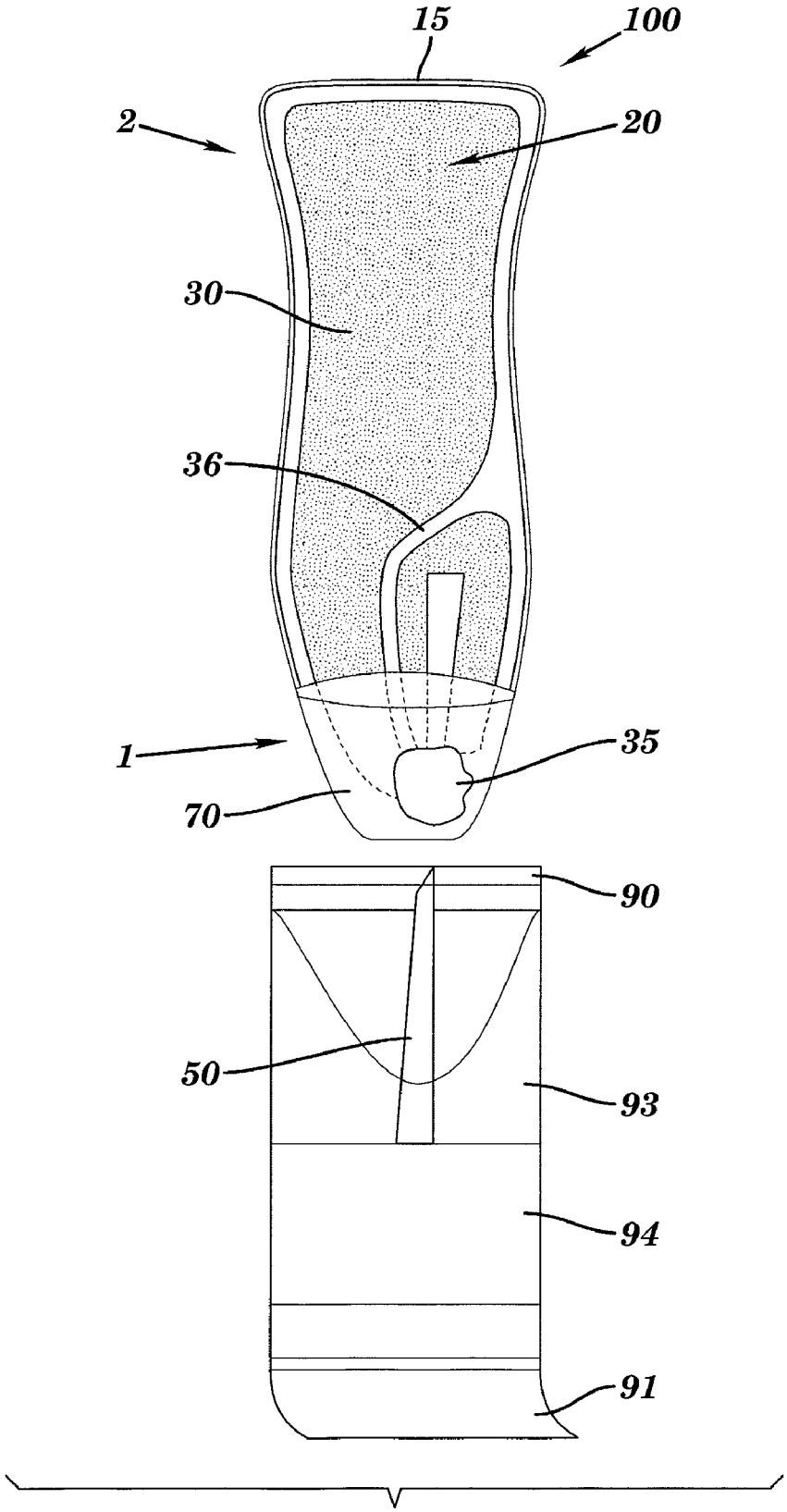
FIG. 4G depicts a perspective view of an embodiment of a pouch and an outer pouch before being placed onto pouch.

With reference to FIGS. 4A-4G, pouch 100 may also include an outer pouch 90 in communication with the actuator 50, wherein the removal of the outer pouch 90 may facilitate the removal of the pulling tab 50. The removal of the outer pouch 90 may also facilitate the formation of access opening 60. The outer pouch 90 may be positioned proximate the first end 1 of the pouch 100, and may cover or substantially cover the first end 1. For instance, the outer pouch 90 may be a sleeve that may sheath the first end 1 and cover or substantially cover a portion of the top pouch layer 20 proximate the first end 1 and a portion of the bottom pouch layer 10. The bottom portion 93 of the outer pouch 90 may be a sleeve, open ended pouch, and the like, formed by two layers, and may encompass, sheath, cover, etc., the pouch 100 proximate the first end 1. The top portion 94 of the outer pouch 90 may include two layers sealed together. Furthermore, a portion of the actuator 50 proximate the second end 54 may be bonded, fixed, attached, adhered, fastened, etc., to the inner surface of the outer pouch 90. In one embodiment, a portion of the actuator 50 proximate the second end 54 may be bonded, fixed, attached, adhered, fastened, etc., to the inside surface of the outer pouch 90 between the sealed layers of the outer pouch 90 or placed between the sealed layers of the outer pouch 90. Once the outer pouch 90 is placed over the pouch 100, the top portion 94 may be folded over and attached to the bottom portion 93, as depicted in FIG. 4F. Additionally, the top portion 94, or folded portion of the outer pouch 90 may be bonded to the stronger side of a differential adhesive such that it may free one side of the outer pouch 90 when the outer pouch 90 is pulled. In many embodiments, the outer pouch 90 may be made of a laminate of PET/LDPE.

Furthermore, the outer pouch 90 may also have a lip 91 to facilitate the gripping, grabbing, pinching, etc., of the outer pouch 90. The lip 91 of the outer pouch 90 may be peeled back in a generally opposing, coplanar direction from the pouch 100 to remove the outer pouch 90. Because a portion of the actuator 50 may be connected, bonded, or in communication with the inner, or inside, surface of the outer pouch 90, the actuator 50 may be simultaneously removed with the removal of the outer pouch 90. For instance, unfolding the outer pouch 90 and removing it from the pouch 100 may make the shearing and/or breaching of the seal 36 easier due to the created inertia of the unfolding and pulling forces. Alternatively, the outer pouch 90 may be weakened with perforations to avoid folding over the top portion 94. When removing the outer pouch 90, the actuator 50 may breach the seal 36 and create an access opening 60 to the contents 35 inside the reservoir 30. Thus, with one, single motion contents 35 may be accessed from a sealed reservoir 30, and ready to be used.

Figure 5:
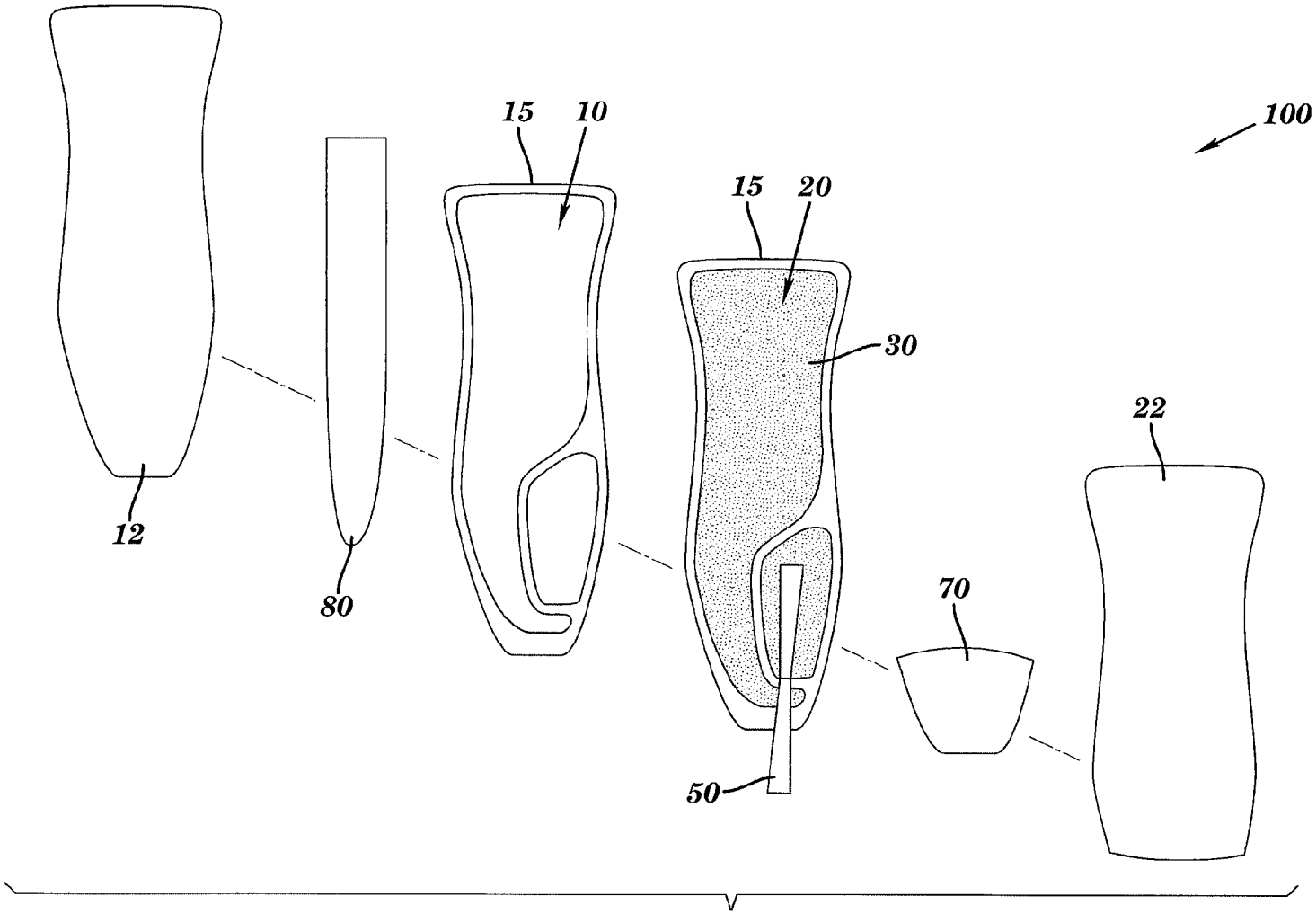
FIG. 5 depicts an exploded view of an embodiment of a pouch.

Referring now to FIG. 5, the pouch 100 may include a stiffener 80 fastened to the back of the bottom pouch layer 10. The stiffener 80 may be fastened, bonded, affixed, attached, glued, adhered, etc., to the pouch 100. The stiffener 80 may be made out of any material that may provide stability to the overall structure, but not contribute to a heavy increase in mass or weight. In many embodiments, the stiffener 80 may be a thin, resilient material. In one embodiment, the stiffener 80 may be made out of cardboard. In another embodiment, the stiffener 80 made be made out of polyester film, between 5 and 15 mils in thickness. Additional stiffener 80 materials include Polyvinyl Chloride (PVC), Styrene, Nylon or chipboard. Furthermore, the stiffener 80 may be narrower than the top and bottom pouch layers 20, 10 to allow more contents 35 to fit inside the reservoir 30. To accommodate more contents 35 into the pouch 100, the top and bottom pouch layers 20, 10 may expand and open up; therefore, the design and shape of the stiffener 80 may try to avoid restraining or constricting such expansion.

Additionally, a bottom label 12 may be placed over or onto the back of the bottom pouch layer 10. The bottom label 12 may be placed over a stiffener 80 to help hold the stiffener in place. Moreover, a top label 22 may be placed over or onto the top pouch layer 20; however, the top label 22 may not prevent the actuator 50 from breaching the seal 36. Both the top and bottom labels 22, 12, may be bonded, glued, affixed, glued, adhered, placed, and/or pressed onto the top pouch layer 20 and bottom pouch layer 10, respectively. The top and bottom labels 22, 12 may accept, represent, showcase, etc., high quality print. For example, the labels 22, 12 may display a product logo or trademark, ingredients, directions, warnings, fanciful designs, and the like. Labels 22, 12 may also provide the pouch 100 with slightly more stability and stiffness.

Figure 6:
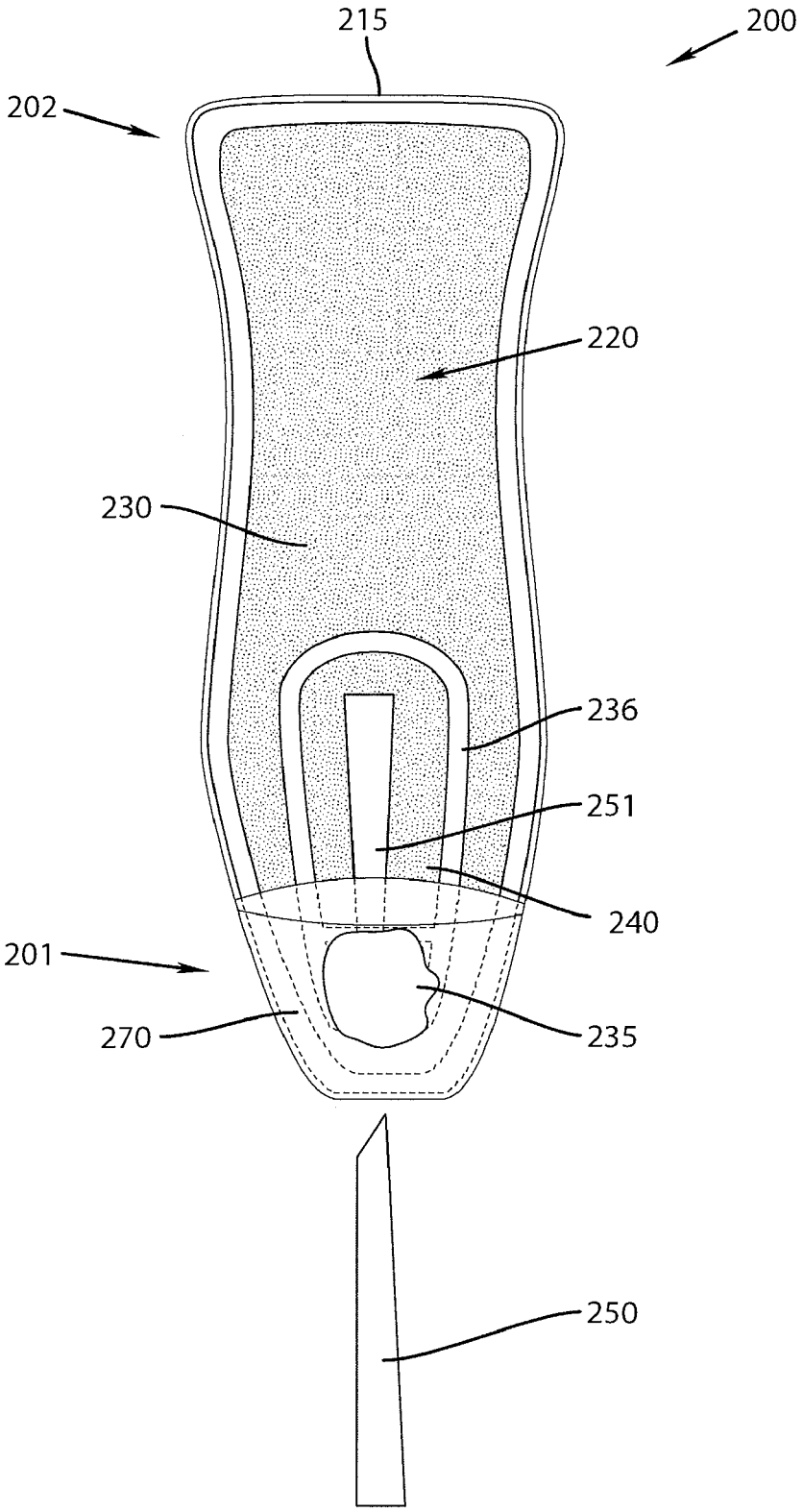
FIG. 6 depicts a top view of an embodiment of a pouch having an intermediate layer.
Figure 7:
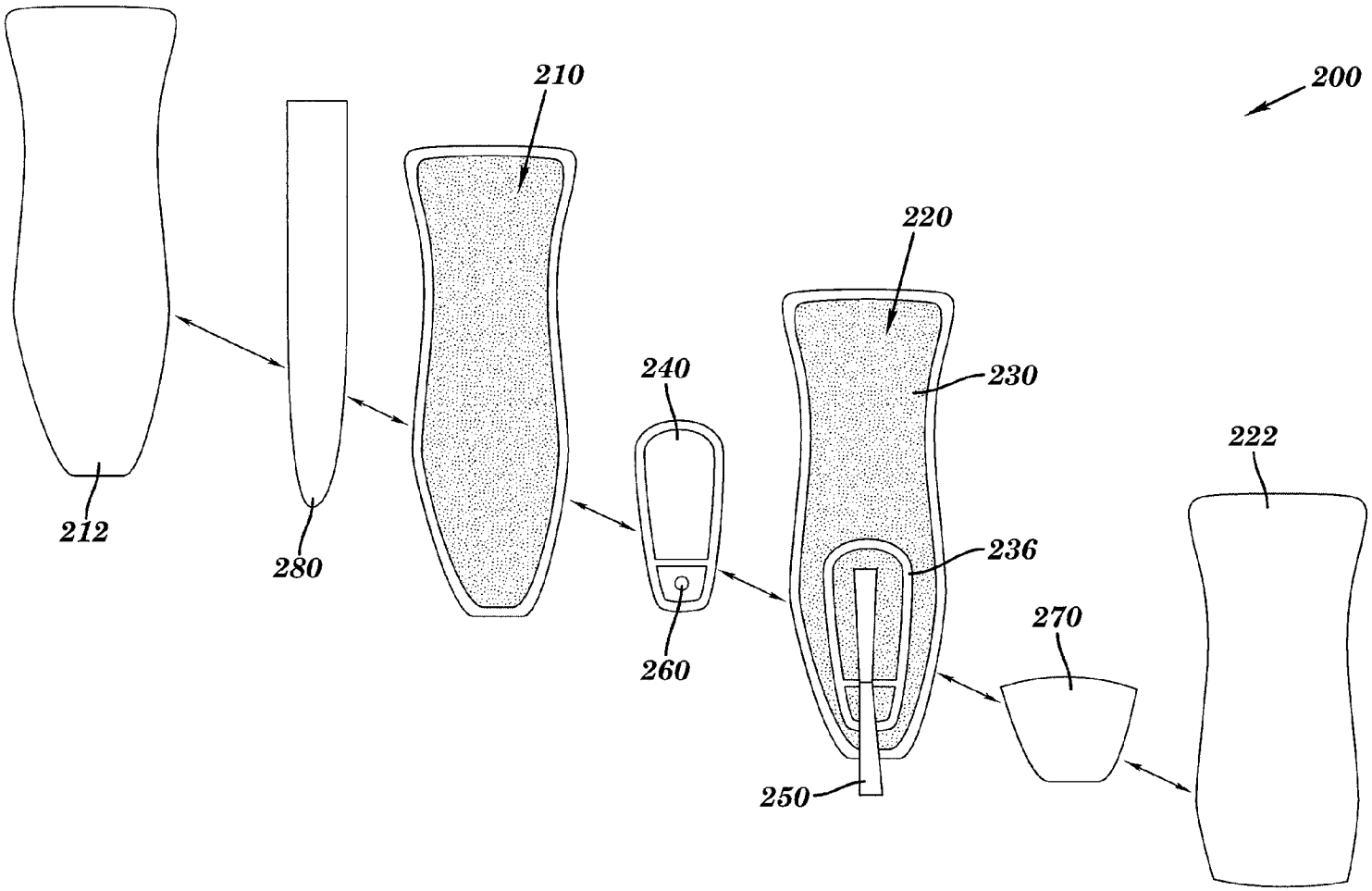
FIG. 7 depicts an exploded view of an embodiment of a pouch having an intermediate layer with an aperture zone.

FIG. 6 depicts an embodiment of pouch 200, wherein pouch 200 may include an intermediate layer 240, a actuator 250, a top pouch layer 220, a bottom pouch layer 210, an applicator 270, a seal 236, a reservoir 230, a first end 201, and a second end 202. In other embodiments, as shown by FIG. 7, the intermediate layer 240 may include an aperture zone, which may include an aperture, and may be sealed to the inner surface of the top pouch layer 220. The intermediate layer 240 may be heat sealed onto the inner surface of the of the top pouch layer 220. The heat seal that seals the intermediate layer 240 to the inner surface of the top pouch layer 220 may be referred to as seal 236. Seal 236 may restrict access to the contents 235. In other words, if seal 236 is breached, contents 235 may exit the reservoir 230. There may also be an outer seal and an inner, island seal that may be breached. Furthermore, actuator 250 may be created from a portion of top pouch 220 which resides above the intermediate layer 240. Pulling the actuator 250 may breach the seal 236, and create an access opening 260 for contents 235 to exit the reservoir 230. The inclusion of the intermediate layer 240, in particular, sealing it to the inner surface of the top pouch layer 220, may result in a larger volume reservoir 230. Thus, when the pouch layers 210, 220 are sealed together to form reservoir 230 between them, no surface area may be wasted by a pull tab zone 40 being located adjacently. Pouch 200 may also include an applicator 270, a stiffener 280, an outer pouch 290, a bottom label 212, and a top label 222.

Figure 8:
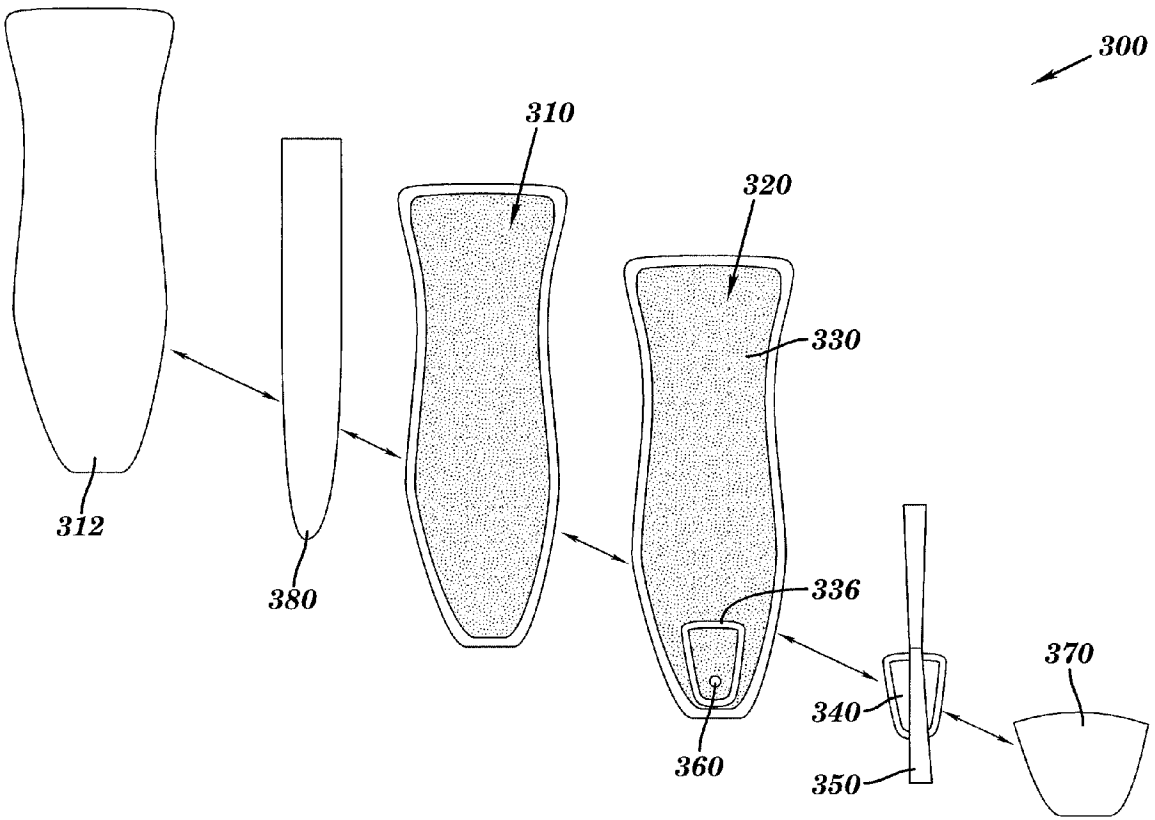
FIG. 8 depicts an exploded view of an embodiment of a pouch having an external tear patch.

Referring now to FIG. 8, pouch 300 may include a top pouch layer 320, a bottom pouch layer 310, a reservoir 330, a seal 336, an access opening 360, an external tear patch 340, a actuator 350, a first end 301, and a second end 302. The edges of the top pouch layer 320 may be heat sealed to the edges of the bottom pouch layer 320 to form a reservoir 330 between them. The edges and/or perimeter of the external tear patch 340 may be sealed to the top pouch layer 320, wherein the external patch 340 covers the access opening 360. The sealing of the external tear patch 340 to the top pouch layer 320 may form the seal 336. A actuator 350 may be formed by a portion of the external tear patch 340, and folded back towards the first end 301. Pulling the actuator 350 may shear and/or breach the seal 336, which exposes the access opening 360, and any contents 335 that may have exuded or exited the reservoir 330 through the access opening 360. Pouch 300 may also include an applicator 370, a stiffener 380, an outer pouch 390, a bottom label 312, and a top label 322.

Figure 9:
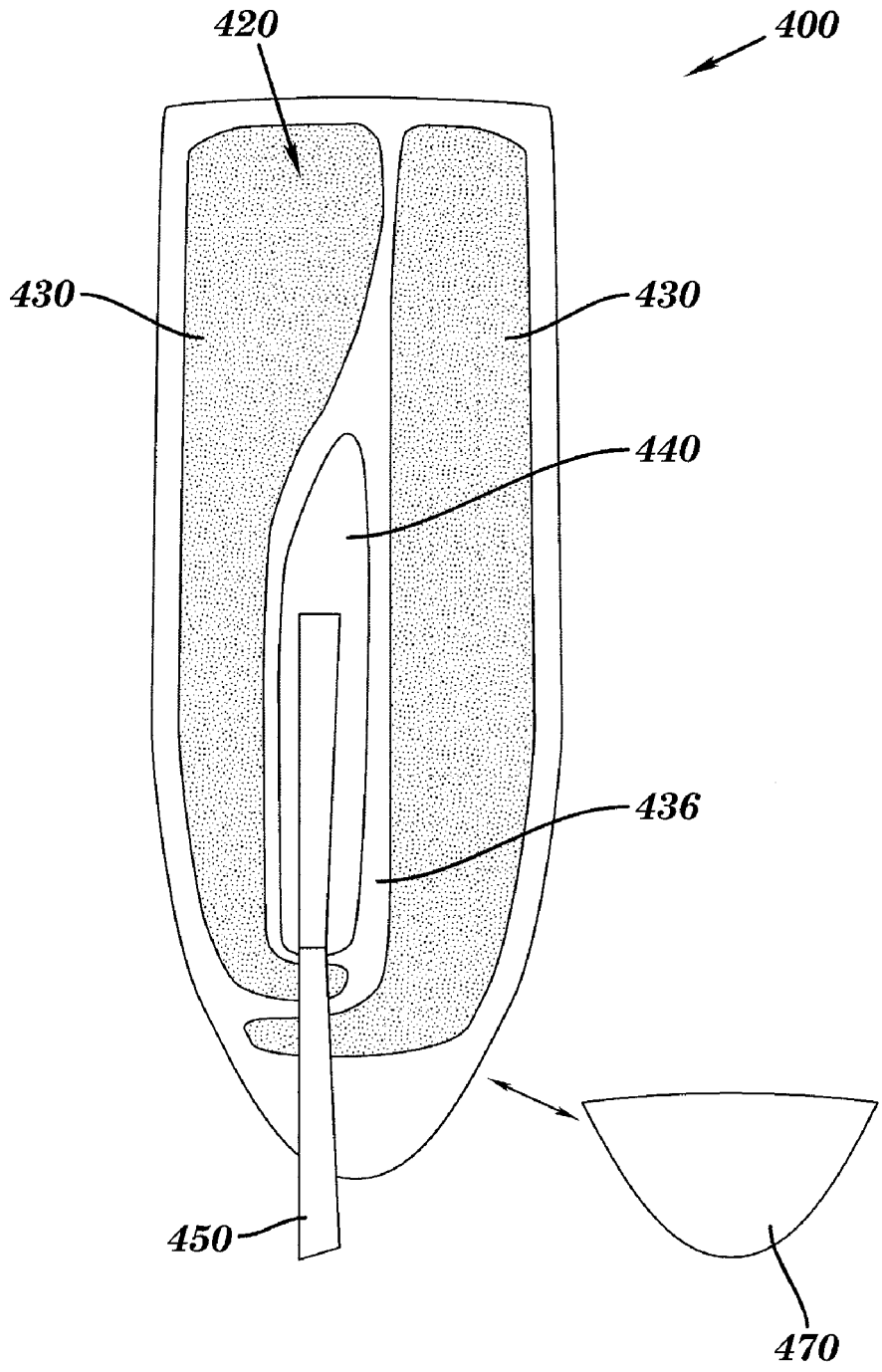
FIG. 9 depicts an exploded view of an embodiment of a pouch having dual reservoirs.

FIG. 9 depicts an embodiment of pouch 400. Pouch 400 may also include a top pouch layer 420 heat sealed to a bottom pouch layer 410 to form at least one reservoir 430, wherein the at least one reservoir 430 may hold contents 435, a actuator 450 proximate a first end 401, wherein the actuator 450 may breach a portion of the heat seal 436 proximate the first end 401, and an access opening 460 created by the breach of the heat seal 436 allowing the contents 435 to exit the reservoir 430. Additionally, pouch 400 may include a pull tab zone 440, a pull tab cut-out 451, a second end 402, and a seal 436. Pouch 400 may include a plurality of reservoirs 430, such as a dual system of reservoir 430. For example, one of said dual reservoirs 430 may contain one type of contents 435, while the other reservoir 430 may contain a different type of contents 435. The pull tab zone 440 and the actuator 450 may be positioned such that pulling the actuator 450 may breach seal 436 in more than one location. For example, the actuator 450 may breach the seal 436 proximate one of the plurality of reservoirs 430, while breaching the seal 436 proximate the other reservoir 430 immediately thereafter. Thus, pulling the actuator 450 may create more than one access opening 460, allowing contents 435 from more than reservoir 430 to exit. Pouch 400 may also include an applicator 470, a stiffener 480, an outer pouch 490, a bottom label 412, and a top label 422.

With reference to FIGS. 1-9, a method of packaging a fluid, or contents 35 may comprise the steps of joining a bottom pouch layer 10 with a top pouch layer 20 to form at least one reservoir 30, wherein each of the at least one reservoirs 30 holds contents 35, extruding a portion of the top pouch layer 20 to form a actuator 50, wherein the actuator 50 is formed from an area that does not hold contents 35, and pulling the actuator 50 to create at least one opening 60, the at least one opening 60 created somewhere over one of the at least one reservoir 30. The method may further comprise the steps of folding the actuator 50 over a portion of a seal 36, wherein the actuator 50 breaches the portion of the seal 36, positioning an applicator 70 over the opening 60, and coupling the actuator 50 to an outer pouch 90 to facilitate breaching of the portion of the seal 36, wherein the outer pouch 90 substantially covers a first end 1. Furthermore, joining a bottom pouch layer 10 with a top pouch layer 20 to form at least one reservoir 30 may include heat sealing the top pouch layer 20 to the bottom pouch layer 10.

Various modifications and variations of the described apparatus and method will be apparent to those skilled in the art without departing from the scope and spirit of the invention. Although this invention has been described in connection with specific embodiments, outlined above, it should be understood that the invention should not be unduly limited to such specific embodiments. Various changes may be made without departing from the spirit and scope of the invention.

The invention claimed is:

1. A pouch comprising:

a top pouch layer;

a bottom pouch layer sealed to the top pouch layer to form a reservoir, wherein the reservoir is configured to hold contents; and an actuator formed from a portion of the top pouch layer, wherein the portion of the top layer is sealed with a corresponding portion of the bottom layer;

wherein actuation of the actuator breaches a portion of the seal between the top pouch layer and the bottom pouch layer to release the contents from the reservoir.

2. The pouch of claim 1, further comprising:

an applicator positioned proximate the actuator;

a stiffener bonded to the bottom layer; and an outer pouch in communication with a pull tab, wherein removal of the outer pouch facilitates the actuation of the actuator.

3. The pouch of claim 1, wherein a sleeve is mounted to the back of the bottom layer to allow access of an appendage to assist application of the contents.

4. The pouch of claim 1, wherein a label sheet is placed over the top pouch layer.

5. The pouch of claim 1, wherein the contents are selected from the group consisting of: skin cleaning products, alcohol, betadine, iodine, hydrogen peroxide, antibiotic creams, zinc creams, sun tan lotions, tanning lotions, topical medicines, acne medicine, rosaria, psoriasis, bug repellant, poison oak neutralizer, moisturizers, lotions, creams, toothpaste, tooth ache relief gel, denture gel, denture cream, shoe polish, specialty cleaners, polishers, silver, copper, plastic, dish washing fluid, paints, stains, adhesives, face paint colors, calking, spackle, condiments, catsup, mustard, and relish.

6. A method of packaging a fluid comprising:

joining a bottom pouch layer with a top pouch layer to form at least one reservoir, wherein each of the at least one reservoirs is configured to hold contents;

extruding a portion of the top pouch layer to form an actuator, wherein the actuator is formed from an area that does not hold contents; and actuating the actuator to reveal at least one opening, the at least one opening configured to allow contents to pass through, wherein actuating the actuator breaches a portion of a seal between the top pouch layer and the bottom pouch layer.

7. The method of claim 6, further comprising:

positioning an applicator proximate a first end of the pouch; and coupling the actuator to an outer pouch to facilitate breaching of the portion of the seal, wherein the outer pouch substantially covers the first end of the pouch.

8. The method of claim 6, wherein joining includes heat sealing the top pouch layer to the bottom pouch layer.

9. The method of claim 6, wherein the seal defines the edges of the at least one reservoir.

10. The method of claim 6, wherein the contents are selected from the group consisting of: skin cleaning products, alcohol, betadine, iodine, hydrogen peroxide, antibiotic creams, zinc creams, sun tan lotions, tanning lotions, topical medicines, acne medicine, rosaria, psoriasis, bug repellant, poison oak neutralizer, moisturizers, lotions, creams, toothpaste, tooth ache relief gel, denture gel, denture cream, shoe polish, specialty cleaners, polishers, silver, copper, plastic, dish washing fluid, paints, stains, adhesives, face paint colors, calking, spackle, condiments, catsup, mustard, and relish.

11. The method of claim 6, wherein prior to actuating the actuator to breach the seal between the top pouch layer and the bottom pouch layer, the method includes the step of folding the actuator towards the seal without breaching the seal to secure the contents while facilitating gripping of the actuator.

* * * * *